United States Patent [19]

Bartley

[11] Patent Number: 4,575,013

[45] Date of Patent: Mar. 11, 1986

[54] MINERAL BREAKER

[75] Inventor: Bryan A. Bartley, Auckland, New Zealand

[73] Assignee: Barmac Associates Limited, Wellington, New Zealand

[21] Appl. No.: 517,022

[22] Filed: Jul. 25, 1983

[30] Foreign Application Priority Data

Jul. 28, 1982 [NZ] New Zealand ..... 201418

[51] Int. Cl.[4] ..... B02C 23/32

[52] U.S. Cl. ..... 241/275; 241/52; 241/62; 241/97

[58] Field of Search ..... 241/52, 79.1, 80, 97, 241/275, 284, 61, 62, 57

[56] References Cited

U.S. PATENT DOCUMENTS 2,103,454 12/1937 Graemiger et al. ..... 241/52 X 2,350,737 6/1944 Eiben ..... 241/61 X 3,970,257 7/1976 MacDonald et al. ..... 241/275

4,133,487 1/1979 Lanier ..... 241/275 X 4,461,428 7/1984 Williams ..... 241/57 X

*Primary Examiner*—Howard N. Goldberg

*Assistant Examiner*—Joseph M. Gorski

*Attorney, Agent, or Firm*—Ladas & Parry

[57] ABSTRACT

A mineral breaker with a horizontally mounted driven accelerating rotor having a mineral inlet on the under surface thereof and with material to be processed being drawn into the rotor in a flow of air. The processed material is discharged also in a flow of air through a tube or tubes from the top of the rotor housing. Mineral pieces not sufficiently reduced in size may be recirculated through the rotor and additional material added for further processing. The size of processed particles is controlled by the airflow passing through the rotor.

3 Claims, 1 Drawing Figure

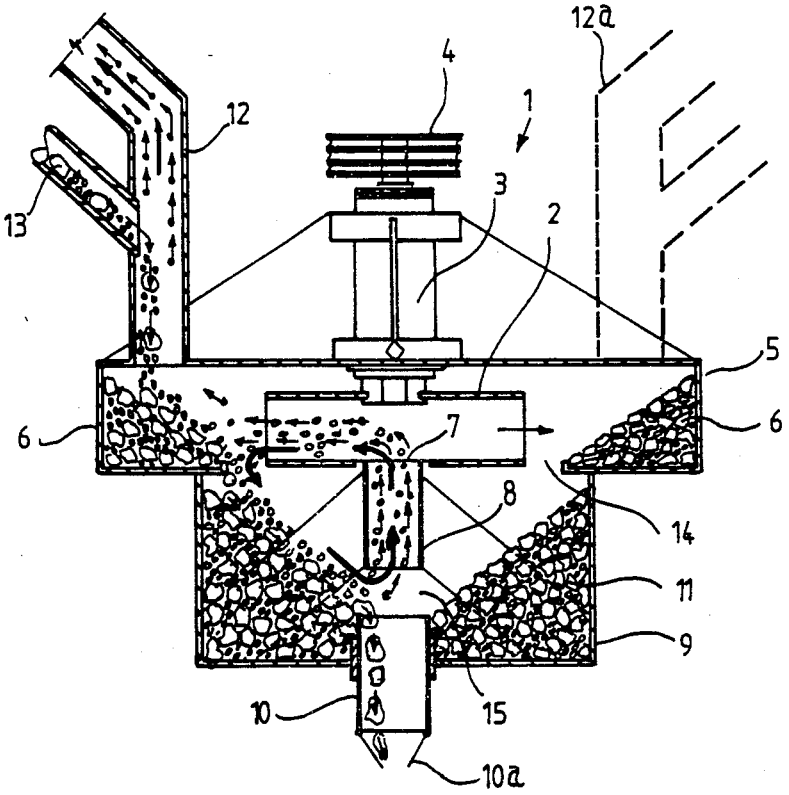
12a
4
1
12
3
2
13
5
6
7
6
8
14
11
9
10
15
10a

MINERAL BREAKER

This invention relates to mineral breakers.

BACKGROUND

In some operations it is necessary to reduce minerals to a comparitively fine particle size. This can be achieved in a number of ways but with a centrifugal accelerating rotor it cannot be achieved satisfactorily in a single pass through the apparatus. While the material can be reconveyed to the inlet for reprocessing this is costly and not particularly effective with the normal centrifugal type of mineral breaker. A mineral breaker of the type referred to has been described and claimed in U.S. Pat. No. 3,970,257.

PRESENT INVENTION

The present invention is directed to a mineral breaker which is particularly adapted for closed circuit operation of the mineral pieces until they have been suitably reduced. The present breaker is therefore designed to allow for the reduction of minerals to a relatively fine particle form in an efficient and effective way or in a manner which provides a useful choice over known and existing apparatus.

Broadly the invention consists in (follow claim 1).

DRAWING DESCRIPTION

One preferred form of the invention will be described with reference to the accompanying drawing which is a diagrammatic sectional elevation of the mineral breaker according to the present invention.

THE PREFERRED EMBODIMENT

The mineral breaker 1 has a horizontal accelerating rotor 2 mounted within a rotor housing 5. The rotor 2 is supported from a bearing assembly 3 on the top of the rotor housing and is driven by a motor (not shown) through a V-belt or direct drive connected at 4 to the shaft of the rotor.

The rotor is preferably of the type described and claimed in U.S. Pat. No. 3,970,257.

In such a rotor material is introduced to the centre of the rotor and accelerated through one or a plurality of paths to be discharged from the periphery into the rotor housing.

The rotor housing is designed with a floor and lip which act as a mineral retaining surface to trap a bed of mineral pieces 6 and form an inclined impact surface made up of stone so that the accelerated mineral pieces discharged from the rotor will impact against the surface.

An annular gap 14 between the lower periphery of the rotor 2 and the floor of the rotor housing 5 allows mineral pieces to pass into a secondary housing 9.

The secondary housing 9 which extends from the under surface of the rotor housing has an outlet centrally in the base thereof. A draught control tube 10 is located in the outlet with the section of the tube projecting into the housing and the floor of the housing providing mineral retaining surfaces which bank up a bed of mineral particles 11 in the secondary housing. The bed of mineral particles guides the mineral pieces that have fallen through the annular gap over a stone surface down to the outlet via the draught control tube.

In the operation of the machine it is important to be able to control the amount of air passing up through the draught tube and draught regulating means 10*a* are associated with the draught tube to achieve this end. These draught regulating means can be controlled by a suitable control mechanism and set to the required opening. The draught control means will of course still allow mineral particles to pass therethrough as will be described in more detail here below.

A fixed feed tube 8 is located immediately below the inlet 7 to the rotor 2 and extends from the inlet 7 to a point with the lower periphery of the feed tube 8 adjacent the top of the draught tube 10. There is a sufficient gap between the two so that mineral pieces can pass but the combination of the guiding bank of mineral particles and the two tubes 8 and 10 is such that mineral pieces are directed into the airflow coming from the draught tube and up into the rotor via the feed tube 8.

Mineral pieces below a certain size will be carried in the airflow up the tube 8 and into the rotor to be accelerated and impact with the mineral already contained in the housing 2. The size of the particles being transported will be regulated by the volume of air which is allowed to pass.

The outlet from the rotor housing is in the top surface thereof and comprises a tube 12 through which the airflow is allowed to pass. The airflow will carry with it mineral particles which have been reduced below a certain size. More than one outlet tube can be formed and a second tube 12*a* is illustrated in dotted outline in the drawings. The mineral particles entrained in the air outlet can be separated using a cyclone or other suitable separating mechanism through which the air and entrained particles is caused to pass.

A mineral infeed into the apparatus is provided through a pipe or tube 13 extending in as a branch feed into the outlet 12. This allows the mineral pieces to be added to the flow of mineral pieces being circulated through the rotor.

The operation of the mineral breaker according to the present invention should be clear from the foregoing. The apparatus is started with mineral infeed being introduced to allow a build up of the mineral beds as illustrated in the diagrammatic drawing.

An airflow will be generated by the rotor itself tending to draw air through the draught tube and as indicated above this can be controlled by regulating the amount of air that is in fact able to pass through the draught tube. It is also possible to supplement the airflow created by the action of the rotor by introducing an exhaust fan in the discharge conduit or conduits 12. Further the exhaust pressure taken from the cyclone once the processed mineral particles had been removed could be reintroduced into the draught tube.

By regulating the flow of the air passing through the mineral breaker it is possible to regulate the size of the mineral particles produced as the reduced product. Initially the airflow will carry the mineral pieces below a certain size up the tube 8 into the rotor 2. The airflow passing up the tubes 12 will carry mineral pieces of a smaller size and as a reduced product up the tube or tubes 12 and 12*a* and to the cyclone to remove the mineral particles.

The mineral pieces which are not sufficiently reduced in size will fall down the face of the mineral bank 6 through the gap into the supplementary chamber where they will be recycled around the path indicated by arrows in the drawing. It will be seen that the wear surface of the path particularly where a rotor as previously described in our earlier patent specification used is one where a stone is caused to pass over stone or break against stone thereby reducing substantially the wear characteristics of the machine. Particles which are too large to be lifted through the feed chamber into the rotor will be discharged through the draught tube and additional mineral particles can be introduced through the feed 13. In this way the closed circuit operation allows particles of a selected size to be removed through the outlet 12 and a machine to be provided which will operate efficiently and with relatively good wear characteristics.

What is claimed is:

1. A centrifugal disintegrator for reducing particle size of disintegratable mineral material, comprising a rotor housing symmetrical about a longitudinal axis, said rotor housing having a top portion and a floor with substantially vertical walls rising from said floor, an opening in said top portion, an outlet tube fitted in said opening, an opening in a wall of said outlet tube, an infeed means fitted in said opening in the wall of the outlet tube with said infeed means feeding in mineral material to pass into the rotor housing of the centrifugal disintegrator, a centrally located opening in the floor of said rotor housing, a material accelerating rotor with a substantially vertical axis rotatably supported in said rotor housing with a lower surface of said rotor being positioned within the rotor housing and substantially co-planar with said floor of the rotor housing so that an annular opening is defined between the accelerating rotor and the floor, the lower surface of the accelerating rotor having a centrally located opening for a material to be fed into said rotor, means for rotating said accelerating rotor about its substantially vertical axis, a secondary housing symmetrical about said substantially vertical axis and positioned immediately below said rotor housing, said second housing having a floor with walls rising from the floor of the second housing and engaging an undersurface of the rotor housing floor, a centrally located opening in the floor of the secondary housing, a vertical draught tube fitted in said opening of the floor of the secondary housing, a vertical feed tube extending downwardly from the opening in the lower surface of the rotor with a lower end of the feed tube and an upper end of the draught tube defining an opening through which material from the secondary housing may pass so that during rotation of the rotor a draught drawing air generates in the draught tube and passes through the feed tube and the rotor and exits out the outfeed tube with material to be disintegrated fed through the mineral infeed means and initially into the draught in the outlet tube to remove particles which are entrained in an airflow with larger particles falling into the rotor housing and through the annular gap between the floor of the rotor housing and the rotor into the secondary housing to accumulate until material passes into the opening between the draught tube and the feed tube with the rotor induced draught carrying pieces of material up into the rotor for acceleration with material being prevented to entrain in the draught of air into the rotor discharged out the draught tube and with the rotor accelerated material impacting with multiple collisons the infeed material delivered into the rotor housing.

2. A centrifugal disintegrator as claimed in claim 1, including a bed of mineral material held in the rotor housing and forming an impact face minimizing mineral to metal contact within the housing, said bed of mineral material being held in the secondary housing to build up to an inclined guiding face to direct mineral material entering the housing to the opening between the feed tube and the draught tube.

3. A centrifugal disintegrator as claimed in claim 1 including draught regulating means fitted in association with the draught tube for regulating the inflow of air.

* * * * *